US011255149B1

(12) United States Patent
Cao et al.

(10) Patent No.: US 11,255,149 B1
(45) Date of Patent: Feb. 22, 2022

(54) MULTIFUNCTIONAL DIRECTIONAL WIRELINE CORE DRILLING DEVICE

(71) Applicant: Institute of Exploration Techniques, Chinese Academy of Geological Sciences, Tianjin (CN)

(72) Inventors: Longlong Cao, Tianjin (CN); Hengchun Zhang, Tianjin (CN); Wenshi Wang, Tianjin (CN); Jia Yan, Tianjin (CN); Jie Xu, Tianjin (CN)

(73) Assignee: Institute of Exploration Techniques, Chinese Academy of Geological Sciences, Tianjin (CN)

( * ) Notice: Subject to any disclaimer, the term of this patent is extended or adjusted under 35 U.S.C. 154(b) by 0 days.

(21) Appl. No.: 17/117,486

(22) Filed: Dec. 10, 2020

(30) Foreign Application Priority Data

Nov. 19, 2020 (CN) ..... 202011297328.6

(51) Int. Cl.

| | |
|---|---|
| ***E21B 25/16*** | (2006.01) |
| ***E21B 47/022*** | (2012.01) |
| ***E21B 7/06*** | (2006.01) |
| ***E21B 25/02*** | (2006.01) |

(52) U.S. Cl.
CPC ..... *E21B 25/16* (2013.01); *E21B 7/06* (2013.01); *E21B 25/02* (2013.01); *E21B 47/022* (2013.01)

(58) Field of Classification Search
CPC ..... E21B 25/00–18
See application file for complete search history.

(56) References Cited

U.S. PATENT DOCUMENTS

2021/0164300 A1* 6/2021 Wan ..... E21B 31/18

* cited by examiner

*Primary Examiner* — Kristyn A Hall
(74) *Attorney, Agent, or Firm* — Erickson Kernell IP, LLC

(57) ABSTRACT

A multifunctional directional wireline core drilling device includes an outer assembly, an inner assembly, a core unjamming mechanism, and a directional coring mechanism. According to the present disclosure, wireline core drilling can be fulfilled; in addition, the directional coring mechanism can truly restore the strike and azimuth of a stratum facture by obtaining a core with an azimuth. By controlling the flow of drilling fluid during drilling, the core unjamming mechanism can effectively reduce core abrasion, generated due to jamming in the core barrel, during drilling, so that the core recovery of a fractured stratum prone to causing core jamming and the drilling efficiency are greatly improved.

10 Claims, 4 Drawing Sheets

MULTIFUNCTIONAL DIRECTIONAL WIRELINE CORE DRILLING DEVICE

CROSS-REFERENCE TO RELATED APPLICATION

This application claims the benefit of foreign priority of Chinese application No. 202011297328.6, filed on Nov. 19, 2020.

FIELD

The present disclosure relates to wellbore drilling, in particular to a multifunctional directional wireline core drilling device, belonging to the technical field of drilling devices.

BACKGROUND

Wireline core drilling is a drilling method for geological exploration. In this method, inner assemblies of drilling tools are put into special wireline drill pipes to perform core drilling and then are pulled out of the surface by wireline grabs to obtain cores. There is no need to lift the drill pipes in holes from the surface by hundreds or thousands of meters during the core drilling, so that the operation efficiency is greatly improved. In conventional wireline core drilling methods, external assemblies of drilling tools include a reaming centralizer and a drill bit, which are connected to an external tube, internal assemblies of the drilling tools include a suspended grab mechanism, a single-acting mechanism, a core barrel, a core snap ring seat, a snap ring, for example. The cores obtained by means of the wireline core drilling can assist in knowing the physical properties, structures, and mineral compositions of rocks in strata and evaluating the thicknesses and burial depths of rock strata in the strata. However, conventional wireline core drilling devices have the following problems: 1. the obtained may not be used to accurately determine, by means of measurement, key parameters such as the strike and dip angle of fractures and bedding structures of target reservoirs as well as the directional permeability of rock strata, and cannot provide reliable data for evaluations on resource reservoirs as well as crustal stress analysis during geological exploration; 2. fractured strata prone to causing core jamming are frequently encountered during the core drilling; after entering the core barrel, the cores may be fractured due to stress relief along fractures and thus become rock fragments or scoria; once the core barrel is jammed, other cores may be prevented from entering the core barrel during subsequent core drilling, leading to squeezing and counter friction of fractured cores as well as repeated abrasion of the cores on the drill bit. As a result, the core recovery is insufficient, obtained strata information is incomplete, and the drilling efficiency is greatly affected during the core jamming.

SUMMARY

The present disclosure aims to resolve the technical issue by providing a multifunctional directional wireline core drilling device, which can fulfill core unjamming and accurately obtain occurrence factors of stratum factures and rock bedding as well as other important data.

To resolve the above technical issue, the present disclosure provides the following technical solution:

A multifunctional directional wireline core drilling device, including an outer assembly and an inner assembly, where the inner assembly is provided with a spearhead, a spring clip, a bearing chamber, a bearing group, a mandrel, a core barrel, a core snap ring seat, and a core snap ring from top to bottom is provided. The inner assembly further includes a core unjamming mechanism and a directional coring mechanism, where the core unjamming mechanism is provided with a sliding shaft sleeve, a compression spring, a suspension shaft, a suspension shaft support chamber, a ball check valve, and a connecting shaft of the ball valve; an upper end of the suspension shaft support chamber is connected to a lower end of the bearing chamber. The sliding shaft sleeve in the suspension shaft support chamber has an upper end connected to a lower end of the mandrel through threads; the suspension shaft is arranged on a support bearing in the suspension shaft support chamber and is in sliding fit with a shaft hole in the sliding shaft sleeve; a water hole is formed in the sliding shaft sleeve, and a water hole corresponding to the water hole in the sliding shaft sleeve is formed in the suspension shaft. The compression spring in the suspension shaft support chamber is disposed around the suspension shaft; the ball valve is arranged in a ball valve seat at a lower end of the suspension shaft. The connecting shaft of the ball valve seat is connected to the ball valve seat and the core barrel.

In the multifunctional directional wireline core drilling device described above, the directional coring mechanism is arranged in the core barrel and provided with an electronic multi-point inclinometer and a multi-point inclinometer holder, where there is a cavity in the multi-point inclinometer holder, which has an upper end connected to a lower end of the connecting shaft of the ball valve seat through threads; the electronic multi-point inclinometer is fixedly arranged in the cavity of the multi-point inclinometer holder; and a line for marking the electronic multi-point inclinometer is located on an external wall of the electronic multi-point inclinometer, a line for marking the multi-point inclinometer holder is located on an external wall of the multi-point inclinometer holder, and these two lines are located at a same diameter on a same side of a geometric center of the electronic multi-point inclinometer and the multi-point inclinometer holder.

In the multifunctional directional wireline core drilling device described above, the core snap ring seat is connected to a lower end of the core barrel through threads and has a conical internal surface, and the core snap ring is arranged on the conical internal surface; a main cutter is arranged on an internal wall of a lower end of the core snap ring seat; and a line for marking the core snap ring seat, which corresponds to the main cutter, is located on an external wall of the lower end of the core snap ring seat.

In the multifunctional directional wireline core drilling device described above, a line for marking the core barrel is located on an external wall of the core barrel, a flow channel circumferentially formed in the core barrel is axially located in an internal wall of the core barrel.

In the multifunctional directional wireline core drilling device described above, blocks for centralizing the electronic multi-point inclinometer are uniformly distributed in three rows on the external wall of the electronic multi-point inclinometer, and there are several blocks in each said row.

In the multifunctional directional wireline core drilling device described above, two cutters for centralization are arranged on an internal wall of the lower end of the core snap ring seat and are symmetric relative to the main cutter; and an included angle between the two cutters for centralization is 60°, and an included angle between each said cutter for centralization and the main cutter is 150°.

In the multifunctional directional wireline core drilling device described above, a water hole is formed in an internal wall of the suspension shaft support chamber.

In the multifunctional directional wireline core drilling device described above, an overflow hole for drilling fluid is formed in a bottom of the multi-point inclinometer holder.

In the multifunctional directional wireline core drilling device described above, a portion, in sliding contact with the suspension shaft, of the sliding shaft sleeve has a hexagonal cross section.

In the multifunctional directional wireline core drilling device described above, the support bearing group in the suspension shaft support chamber is disposed around the suspension shaft.

According to the present disclosure, conventional wireline core drilling, core unjamming, and directional core drilling can be fulfilled; a directional coring mechanism obtains a core with an azimuth recorded by means of a wireline core drilling technology and truly restores the strike and azimuth of a stratum facture by means of multi-point azimuth data obtained by an inclinometer as well as the core with an azimuth line, thus providing an important way to research a fracture system; the fracture systems are accurately researched to effectively evaluate dynamic states of oil and gas in a fractured reservoir as well as the damage degree of drilling fluid, hydraulic fracturing fluid, and fluid for water injection production on the reservoir, and this is an effective technical means to evaluate shale oil and shale gas resources, geothermal exploitation, and crustal stresses obtained by means of geological exploration; and a core unjamming mechanism effectively reduces the core abrasion, generated because a core barrel is jammed with the core, during drilling, thus improving the core recovery of a fractured stratum prone to causing core jamming, increasing the integrity of stratum information, and improving the drilling efficiency by solving the problem that the speed of the core drilling is decreased due to the core jamming.

DETAILED DESCRIPTION

The present disclosure is described in detail with reference to the accompanying drawings.

Figure 1:
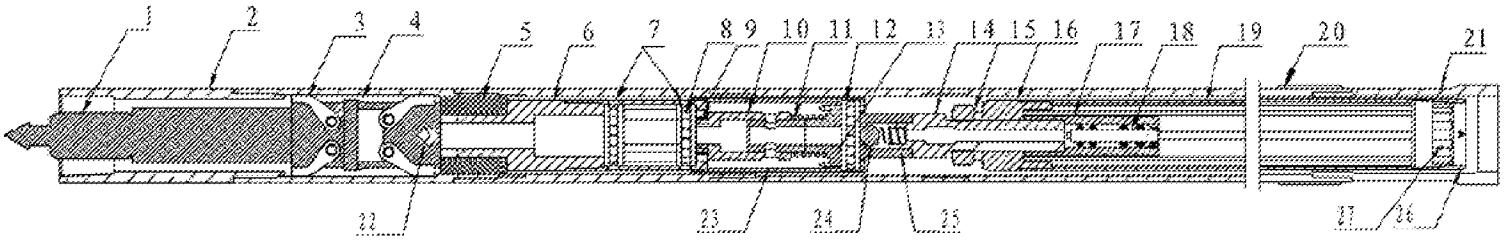
FIG. 1 is a sectional structure diagram of the present disclosure.
Figure 2:
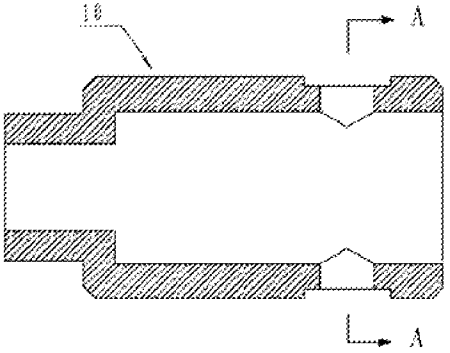
FIG. 2 is a sectional structure diagram of a sliding shaft sleeve.
Figure 3:
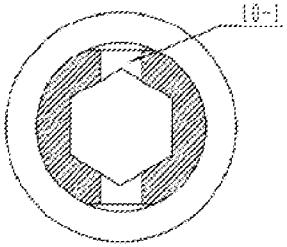
FIG. 3 is a sectional structure diagram of A-A in FIG. 2.
Figure 5:
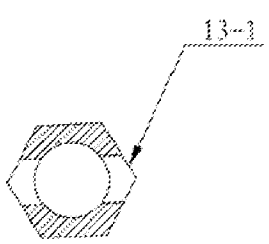
FIG. 5 is a sectional structure diagram of B-B in FIG. 4.
Figure 4:
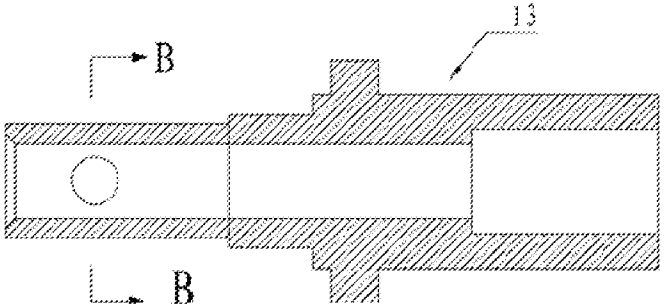
FIG. 4 is a sectional structure diagram of a suspension shaft.
Figure 6:
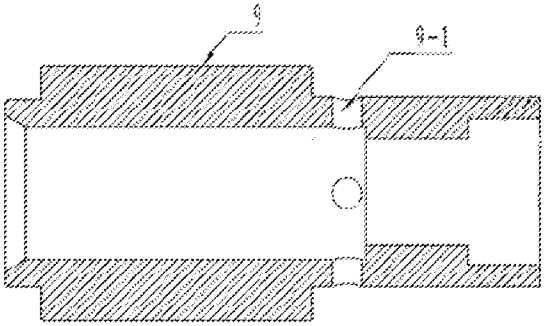
FIG. 6 is a sectional structure diagram of a mandrel.
Figure 8:
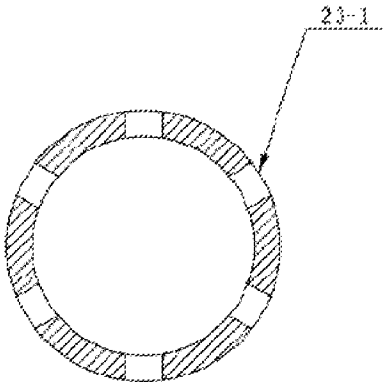
FIG. 8 is a sectional structure diagram of C-C in FIG. 7.

Referring to FIG. 1, a multifunctional directional wireline core drilling device includes an outer assembly and an inner assembly, where the outer assembly includes an external tube 2, a reaming centralizer 20, and a drill bit 21, which are sequentially connected in series to form a wireline coring channel. The inner assembly is nested in the wireline coring channel of the outer assembly and includes a spearhead 1, a bounce chamber 4, and a bearing chamber 6, which are sequentially connected through threads; a spring clip 3 is arranged in the bounce chamber 4 and can return to the bounce chamber when the spearhead 1 is tensioned. A sealing sleeve 5 on an upper portion of the bearing chamber 6 is used to change the flow direction of drilling fluid; bearing groups 8 are arranged at upper and lower ends of a mandrel 9, and an overflow hole 9-1 is formed in the mandrel having the lower end penetrating through a central hole in the bearing chamber; a core barrel connector 16 and a core barrel 19 are connected to a lower end of a connecting shaft 14 of a ball valve seat through threads and locked by means of a locknut 15. A lower end of the core barrel is connected to a core snap ring seat 26 through threads; and a core snap ring 27 is arranged in the core snap ring seat in a matching manner. When a drilling device performs core drilling normally, the inner assembly is suspended in the outer assembly through the spring clip 3 to be locked top and bottom, so as to plug the wireline coring channel. When the drilling device completes the core drilling, the spring clip returns to the bounce chamber under tension, so that the inner assembly is unlocked. Furthermore, the inner assembly is controlled by a grab to move up and down in the wireline coring channel.

Referring to FIG. 1-8, a core unjamming mechanism arranged on the multifunctional directional wireline core drilling device to eliminate core jamming includes a sliding shaft sleeve 10, a compression spring 11, a suspension shaft 13, a suspension shaft support chamber 23, a ball valve 24, and the connecting shaft 14 of the ball valve seat, where the suspension shaft support chamber has an upper end connected to a lower end of the bearing chamber as well as a lower end formed with water holes 23-1. The sliding shaft sleeve in the suspension shaft support chamber has an upper end connected to the lower end of the mandrel through threads; the suspension shaft 13 is arranged on a support bearing group 12 in the suspension shaft support chamber and is in sliding fit with a shaft hole in the sliding shaft sleeve; a portion, in sliding contact with the suspension shaft, of the sliding shaft sleeve has a hexagonal cross section. A water hole 10-1 is formed in the sliding shaft sleeve, a water hole 13-1 corresponding to the water hole 10-1 is formed in the suspension shaft, and the water hole 10-1 is the same as the water hole 13-1 in size and shape; the compression spring 11 in the suspension shaft support chamber is disposed around the suspension shaft. The ball valve 24 is arranged in a ball valve seat 25 at a lower end of the suspension shaft; and the connecting shaft 14 of the ball valve seat is connected to the ball valve seat and has a lower end connected to the core barrel 19. During normal core drilling, the drilling fluid flows into an annular space between the inner assembly and the outer assembly and then flows into an internal channel of the inner assembly via an overflow hole 22 in the bounce chamber. When the drilling fluid flows through the bearing chamber 6, a small part of the drilling fluid lubricates the bearing group 8 via the overflow hole 9-1 and a water hole 7 for bearing lubrication and then flows into the annular space between the inner assembly and the outer assembly. Most of the drilling fluid flows into an internal channel of the sliding shaft sleeve 10 via an internal channel of the mandrel 9 and then flows out of the water hole 10-1 and the water hole 13-1 to lubricate the support bearing group 12 via the water holes 23-1. After that, this drilling fluid flows into the annular space between the inner assembly and the outer assembly, and flows towards the drill bit along a channel in the annular space to wash and cool the drill bit; and afterwards, the drilling fluid carried with rock powder return to the surface along an annular space between the outer assembly and a borehole wall. When jammed with a core during drilling, the core barrel upwards moves under the effect of upward frictional resistance of the core, so as to compress the compression spring. In this way, the water hole in the suspension shaft and the water hole in the sliding shaft sleeve are closed in a staggered manner; an overflow hole for the drilling fluid is reduced in area, and the pressure of the drilling fluid is increased, so that the ball valve is thrusted to compress a spring of the ball valve, thus opening a channel via which the drilling fluid flows into the core barrel. Such that a large amount of drilling fluid flows into the core barrel and flows downwards via a plurality of flow channels circumferentially formed in the core barrel to remove rock fragments and scoria which cause jamming; and besides, the drilling fluid lubricates a contact surface of the core and the core barrel to reduce resistance of the core entering the core barrel.

As shown in FIG. 1 and FIG. 11-14, a directional coring mechanism for measuring and recording a drilling azimuth is arranged in the core barrel and provided with an electronic multi-point inclinometer 18 and a multi-point inclinometer holder 17, where there is a cavity in the multi-point inclinometer holder, which has an upper end connected to the lower end of the connecting shaft 14 of the ball valve seat through threads. The electronic multi-point inclinometer is fixedly arranged in the cavity of the multi-point inclinometer holder. A line 18-2 for marking the electronic multi-point inclinometer is located on an external wall of the electronic multi-point inclinometer, a line 17-1 for marking the multi-point inclinometer holder is located on an external wall of the multi-point inclinometer holder, and these two lines are located at a same diameter on a same side of a geometric center of the electronic multi-point inclinometer and the multi-point inclinometer holder, that is, the two lines are positioned at the same azimuth angle; blocks 18-1 for centralizing the electronic multi-point inclinometer are uniformly distributed in three rows on the external wall of the electronic multi-point inclinometer, and there are several blocks in each row. The electronic multi-point inclinometer is kept in the center by the blocks during the drilling; and overflow holes 17-2 for the drilling fluid are formed in the bottom of the multi-point inclinometer holder, and the drilling fluid can downwards flow into a drilling tool via these overflow holes. The electronic multi-point inclinometer as a storage type electronic inclinometer system measures an azimuth angle and a deviation angle at regular intervals in downhole and stores multi-point data in its storage; and furthermore, the electronic multi-point inclinometer processes and analyzes the multi-point data by means of an inclinometer system after reaching the ground along with a coring tool.

Figure 10:
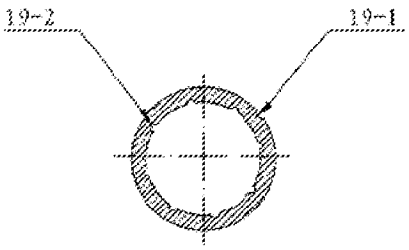
FIG. 10 is a sectional structure diagram of E-E in FIG. 9.
Figure 7:
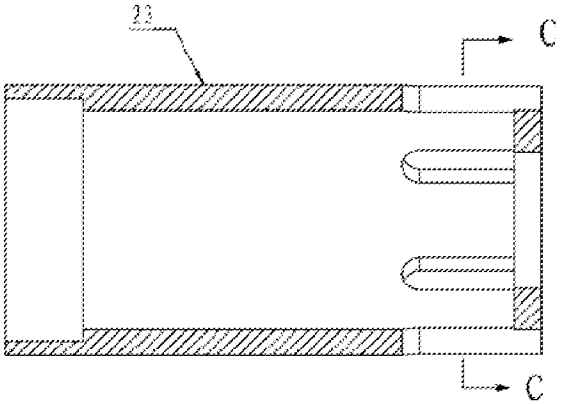
FIG. 7 is a sectional structure diagram of a suspension shaft support chamber.
Figure 9:
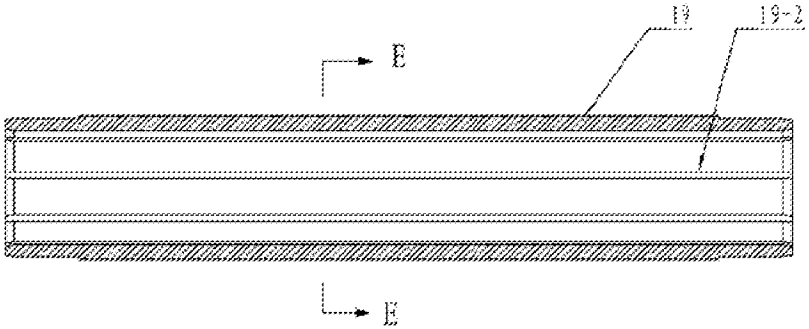
FIG. 9 is a sectional structure diagram of a core barrel.
Figure 12:
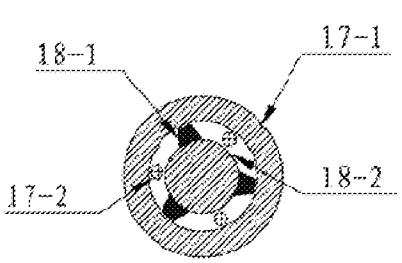
FIG. 12 is a sectional structure diagram of D-D in FIG. 11.
Figure 11:
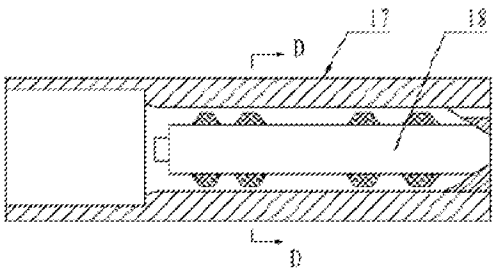
FIG. 11 is a sectional structure diagram of a multi-point inclinometer and a multi-point inclinometer holder.
Figure 14:
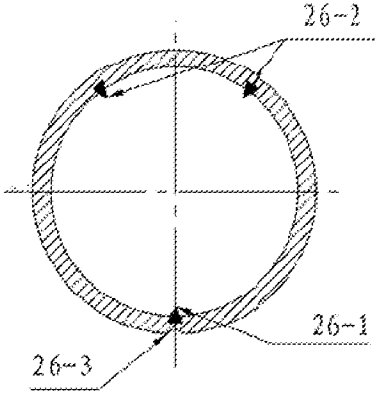
FIG. 14 is a sectional structure diagram of N-N in FIG. 15.
Figure 13:
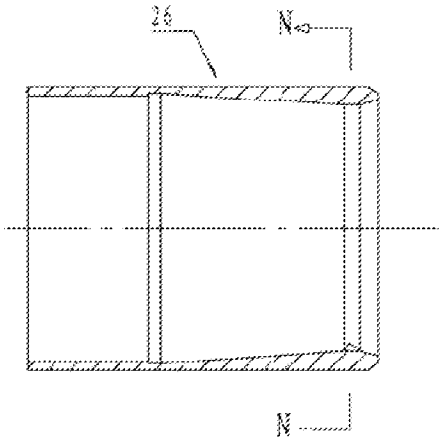
FIG. 13 is a sectional structure diagram of a core snap ring seat.

Referring to FIG. 1 and FIG. 9-10, a line 19-1 for marking the core barrel is located on an external wall of the core barrel 19, and the flow channels 19-2 circumferentially formed in the core barrel are uniformly distributed on an internal wall of the core barrel.

Referring to FIG. 1 and FIG. 11-14, the core snap ring seat 26 is connected to the lower end of the core barrel through the threads and has a conical internal surface, and the core snap ring 27 is arranged on the conical internal surface; a main cutter 26-1 is arranged on an internal wall of the lower end of the core snap ring seat, a line 26-3 for marking the core snap ring seat, which corresponds to the main cutter, is located on an external wall of the lower end of the core snap ring seat. Two cutters 26-2 for centralization are arranged on the internal wall of the lower end of the core snap ring seat and are symmetric relative to the main cutter; an included angle between the two cutters for centralization is 60°, and an included angle between each cutter for centralization and the main cutter is 150°. An inner diameter corresponding to tips of the two cutters for centralization is larger than that corresponding to a tip of the main cutter. During the drilling, when reaching the core snap ring seat in the core barrel, the cutters for centralization of the core snap ring seat centralize the core, and the main cutter of the core snap ring seat makes an azimuth marker on the core. In the directional wireline core drilling device, the relative azimuth of the core barrel is determined by the line for marking the core barrel and the line for marking the multi-point inclinometer holder as well as the line for marking the core snap ring seat and the line for marking the core barrel during installation, and the main cutter and the line for marking the core snap ring seat are kept at the same azimuth angle.

During operation of the directional wireline core drilling device, relative azimuths of the line 17-1 for marking the multi-point inclinometer holder, the line 19-1 for marking the core barrel, the line 26-3 for marking the core snap ring seat can be obtained by means of measurement, so that relative azimuths of the line 18-2 for marking the electronic multi-point inclinometer and the main cutter can be determined in turn. In this way, relative azimuths of the line for marking the electronic multi-point inclinometer and a main marking notch in an obtained core can be determined. Furthermore, a stratum fracture in the core is restored to an original position by means of the notch, made by the main cutter, in the core as well as well data from directional survey and azimuth data which are recorded by the electronic multi-point inclinometer at regular intervals, so that occurrence factors (dip angle, dip) of the stratum fracture and rock bedding can be directly obtained.

What is claimed is:

1. A multifunctional directional wireline core drilling device, comprising:

an outer assembly and an inner assembly, wherein the inner assembly includes from top to bottom, a spearhead, a spring clip, a bearing chamber, a bearing group, a mandrel, a core barrel, a core snap ring seat, and a core snap ring;

the inner assembly further comprises a core unjamming mechanism and a directional coring mechanism, wherein the core unjamming mechanism is provided with a sliding shaft sleeve, a compression spring, a suspension shaft, a suspension shaft support chamber, a ball check valve, and a connecting shaft of the ball valve;

an upper end of the suspension shaft support chamber connected to a lower end of the bearing chamber;

the sliding shaft sleeve in the suspension shaft support chamber having an upper end connected to a lower end of the mandrel through threads;

the suspension shaft arranged on a support bearing group in the suspension shaft support chamber and is sliding fit with a shaft hole in the sliding shaft sleeve;

a first water hole formed in the sliding shaft sleeve, and a second water hole corresponding to the first water hole in the sliding shaft sleeve formed in the suspension shaft;

wherein the compression spring in the suspension shaft support chamber is disposed around the suspension shaft;

wherein the ball valve is arranged in a ball valve seat at a lower end of the suspension shaft; and wherein the connecting shaft of the ball valve seat is connected to the ball valve seat and the core barrel.

2. The multifunctional directional wireline core drilling device according to claim 1, wherein the directional coring mechanism is arranged in the core barrel and provided with an electronic multi-point inclinometer and a multi-point inclinometer holder, wherein there is a cavity in the multi-point inclinometer holder, which has an upper end connected to a lower end of the connecting shaft of the ball valve seat through threads; the electronic multi-point inclinometer is fixedly arranged in the cavity of the multi-point inclinometer holder; and a line for marking the electronic multi-point inclinometer is located on an external wall of the electronic multi-point inclinometer, a line for marking the multi-point inclinometer holder is located on an external wall of the multi-point inclinometer holder, and these two lines are located at a same diameter on a same side of a geometric center of the electronic multi-point inclinometer and the multi-point inclinometer holder.

3. The multifunctional directional wireline core drilling device according to claim 2, wherein the core snap ring seat is connected to a lower end of the core barrel through threads and has a conical internal surface, and the core snap ring is arranged on the conical internal surface; a main cutter is arranged on an internal wall of a lower end of the core snap ring seat; and a line for marking the core snap ring seat, which corresponds to the main cutter, is located on an external wall of the lower end of the core snap ring seat.

4. The multifunctional directional wireline core drilling device according to claim 3, wherein a line for marking the core barrel is located on an external wall of the core barrel, a flow channel circumferentially formed in the core barrel is axially located in an internal wall of the core barrel.

5. The multifunctional directional wireline core drilling device according to claim 4, wherein blocks for centralizing the electronic multi-point inclinometer are uniformly distributed in three rows on the external wall of the electronic multi-point inclinometer, and there are a plurality of blocks in each said row.

6. The multifunctional directional wireline core drilling device according to claim 5, wherein two cutters for centralization are arranged on an internal wall of the lower end of the core snap ring seat and are symmetric relative to the main cutter; and an included angle between the two cutters for centralization is 60°, and an included angle between each said cutter for centralization and the main cutter is 150°.

7. The multifunctional directional wireline core drilling device according to claim 6, wherein a third water hole is formed in an internal wall of the suspension shaft support chamber.

8. The multifunctional directional wireline core drilling device according to claim 7, wherein an overflow hole for drilling fluid is formed in a bottom of the multi-point inclinometer holder.

9. The multifunctional directional wireline core drilling device according to claim 8, wherein a portion, in sliding contact with the suspension shaft, of the sliding shaft sleeve has a hexagonal cross section.

10. The multifunctional directional wireline core drilling device according to claim 9, wherein the support bearing group in the suspension shaft support chamber is disposed around the suspension shaft.

* * * * *